US008594522B2

(12) United States Patent
Soda

(10) Patent No.: US 8,594,522 B2
(45) Date of Patent: Nov. 26, 2013

(54) IMAGE FORMING APPARATUS CAPABLE OF CONTROLLING PRINTING INTERRUPTION, METHOD OF CONTROLLING THE SAME, AND STORAGE MEDIUM

(75) Inventor: Yuji Soda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 13/303,674

(22) Filed: Nov. 23, 2011

(65) Prior Publication Data

US 2012/0134691 A1 May 31, 2012

(30) Foreign Application Priority Data

Nov. 29, 2010 (JP) ..... 2010-264961

(51) Int. Cl.
*G03G 15/00* (2006.01)

(52) U.S. Cl.
USPC ..... 399/44; 399/38

(58) Field of Classification Search
USPC ..... 399/38, 44, 94
See application file for complete search history.

(56) References Cited

U.S. PATENT DOCUMENTS

2011/0142460 A1* 6/2011 Sugano ..... 399/44

FOREIGN PATENT DOCUMENTS

JP 2006-284794 10/2006

* cited by examiner

*Primary Examiner* — G. M. Hyder
(74) *Attorney, Agent, or Firm* — Carter, DeLuca, Farrell & Schmidt LLP

(57) ABSTRACT

An image forming apparatus which makes it possible to prevent interruption of printing due to shift to a temperature rise control mode and interruption of printing for execution of a cartridge replacement operation due to running-out of toner from occurring separately during execution of continuous printing. A temperature sensor detects that the internal temperature of the image forming apparatus has become equal to or higher than a predetermined temperature. The image forming apparatus also detects execution of toner cartridge replacement. When the temperature sensor detects, during execution of printing, that the internal temperature has become equal to or higher than the predetermined temperature, the image forming apparatus stops the printing being executed. Further, when execution of toner cartridge replacement is detected during suspension of the printing, the image forming apparatus resumes the printing being suspended.

9 Claims, 8 Drawing Sheets

IMAGE FORMING APPARATUS CAPABLE OF CONTROLLING PRINTING INTERRUPTION, METHOD OF CONTROLLING THE SAME, AND STORAGE MEDIUM

BACKGROUND OF THE INVENTION

1. Field of the Invention

The present invention relates to an image forming apparatus capable of controlling printing interruption, a method of controlling the same, and a storage medium.

2. Description of the Related Art

In general, the price of an image forming apparatus, such as a copying machine or a printer, has been progressively reduced, and therefore demand for price reduction of a controller for controlling a printer has been increasing.

Further, printers configured to print out an image based on print data received from a host computer include a host-based type that employs, with a view to cost reduction, a printing method in which a host computer rasterizes print data into a format which can be output by the printer, and then delivers the rasterized data to the printer.

As such printers described above, with a tendency toward reduction of apparatus size and price, there has appeared a type which is configured to dispense with a cooling unit, such as a fan. Further, some printers of this type are provided with a temperature rise control mode in which a predetermined cooling time is provided when the printer internal temperature has risen, thereby disabling a printing operation until the printer internal temperature falls.

Further, there has conventionally been proposed a printer that employs an image printing control method in which the remaining amount of toner is constantly monitored and when the amount of used toner exceeds a predetermined threshold value, the mode of printing is switched to an economy mode (see Japanese Patent Laid-Open Publication No. 2006-284794).

In the field of small-sized printers, development of a printer without a cooling unit, such as a fan, has been proceeding so as to achieve reduction of apparatus size and costs.

In such a printer having no cooling unit, however, when a printing operation is started, the printer internal temperature rises in a short time, and hence the printer frequently shifts to the temperature rise control mode, resulting in frequent interruption of the printing operation.

Further, in a small-sized printer, since the amount of toner that can be contained in a small-sized cartridge is limited, interruption of a printing operation due to shortage of toner frequently occurs. In addition, in the small-sized printer, when toner runs out, it is required to replace a toner cartridge with a new one, which causes long-time suspension of a printing operation.

In such a small-sized printer provided with the temperature rise control mode and loaded with a small-sized cartridge, such an operation process is followed as illustrated, by way of example, in a timing diagram in FIG. 6 which shows printing time in continuous printing. In the operation process illustrated in FIG. 6, when printing is started in a printer, the printer internal temperature rises and the printer shifts to the temperature rise control mode after printing of several tens of sheets. As a consequence, the printing operation is suspended until the printer internal temperature falls.

Even after the printer internal temperature falls and the printer shifts from the temperature rise control mode, if toner runs out after printing of several sheets, the operation process has to shift to cartridge replacement, and therefore it inevitably takes a long time before completion of the printing.

Particularly in a color printer, since toner cartridges corresponding in number to colors in use exist in the printer, shift to the temperature rise control mode and cartridge replacement frequently take place, and therefore it often occurs that a user has to wait for a long time before completion of printing.

SUMMARY OF THE INVENTION

The present invention provides an image forming apparatus which is capable of preventing time required for continuous printing from being increased by separate successive occurrence of interruptions of printing due to a shift to a temperature rise control mode and due to a cartridge replacement operation during execution of continuous printing, to thereby improve user friendliness of the image forming apparatus, a method of controlling the image forming apparatus, and a storage medium storing a program for implementing the method.

In a first aspect of the present invention, there is provided an image forming apparatus including a printing unit configured to print an image on a sheet, comprising a first detection unit configured to detect that an internal temperature of the image forming apparatus has become equal to or higher than a first temperature, a second detection unit configured to detect replacement of a toner cartridge disposed in the image forming apparatus, a control unit configured to control in a case where the first detection unit detects, during execution of printing by the printing unit, that the internal temperature of the image forming apparatus has become equal to or higher than the first temperature, the printing unit to stop the printing being executed, and a first execution resuming unit configured to control in a case where the second detection unit detects replacement of the toner cartridge during suspension of the printing stopped by the control unit, the printing unit to resume the printing being suspended.

In a second aspect of the present invention, there is provided an image forming apparatus including a printing unit configured to perform printing based on input image data, comprising a first detection unit configured to detect that an internal temperature of the image forming apparatus has become equal to or higher than a first temperature, a second detection unit configured to detect that an opening and closing part for replacement of a toner cartridge disposed in the image forming apparatus has been closed, a control unit configured to control in a case where the first detection unit detects, during execution of printing by the printing unit, that the internal temperature of the image forming apparatus has become equal to or higher than the first temperature, the printing unit to stop the printing being executed, and a first execution resuming unit configured to control in a case where the second detection unit detects, during suspension of the printing stopped by the control unit, that the opening and closing part has been closed, the printing unit to resume the printing being suspended.

In a third aspect of the present invention, there is provided an image forming apparatus including a printing unit configured to perform printing based on input image data, comprising a first detection unit configured to detect an internal temperature of the image forming apparatus, a second detection unit configured to detect an amount of toner remaining in a toner cartridge, and a control unit configured to be operable during execution of printing by the printing unit, (1) in a case where the amount of toner remaining in the toner cartridge, which is detected by said second detection unit, is not larger than a first remaining amount, to suspend the printing being executed until replacement of the toner cartridge is performed, (2) in a case where the temperature detected by said first detection unit has become equal to or higher than a first temperature and where the amount of toner remaining in the toner cartridge, which is detected by said second detection unit, is not larger than a second remaining amount larger than the first remaining amount, to suspend the printing being executed until the replacement of the toner cartridge is performed, and (3) in a case where the temperature detected by said first detection unit has become equal to or higher than the first temperature and where the amount of toner remaining in the toner cartridge, which is detected by said second detection unit, is larger than the second remaining amount, to suspend the printing being executed until the temperature detected by said first detection unit becomes equal to or lower than a second temperature lower than the first temperature.

In a fourth aspect of the present invention, there is provided a method of controlling an image forming apparatus that performs printing based on input image data, comprising stopping printing being executed, in a case where an internal temperature of the image forming apparatus has become equal to or higher than a first temperature during execution of the printing, and resuming the printing being suspended, in a case where replacement of a toner cartridge is detected during suspension of the printing by said stopping.

In a fifth aspect of the present invention, there is provided a method of controlling an image forming apparatus that performs printing based on input image data, comprising stopping printing being executed, in a case where an internal temperature of the image forming apparatus has become equal to or higher than a first temperature during execution of the printing, and resuming the printing being suspended, in a case where an opening and closing part for replacement of a toner cartridge is closed during suspension of the printing by said stopping.

In a sixth aspect of the present invention, there is provided a non-transitory computer-readable storage medium storing a computer-executable program for causing a computer to execute a method of controlling an image forming apparatus that performs printing based on input image data, wherein the method comprises stopping printing being executed, in a case where an internal temperature of the image forming apparatus has become equal to or higher than a first temperature during execution of the printing, and resuming the printing being suspended, in a case where replacement of a toner cartridge is detected during suspension of the printing by said stopping.

In a seventh aspect of the present invention, there is provided a non-transitory computer-readable storage medium storing a computer-executable program for causing a computer to execute a method of controlling an image forming apparatus that performs printing based on input image data, wherein the method comprises stopping printing being executed, in a case where an internal temperature of the image forming apparatus has become equal to or higher than a first temperature during execution of the printing, and resuming the printing being suspended, in a case where replacement of a toner cartridge is detected during suspension of the printing by said stopping.

According to the present invention, it is possible to prevent time required for continuous printing from being increased by separate successive occurrence of interruptions of printing due to a shift to a temperature rise control mode and due to a cartridge replacement operation during execution of continuous printing, to thereby improve user friendliness of the image forming apparatus, Further features of the present invention will become apparent from the following description of an exemplary embodiment with reference to the attached drawings.

DESCRIPTION OF THE EMBODIMENTS

The present invention will now be described in detail below with reference to the accompanying drawings showing an embodiment thereof.

In the following, the embodiment of the present invention will be described in detail with reference to the drawings.

Figure 2:
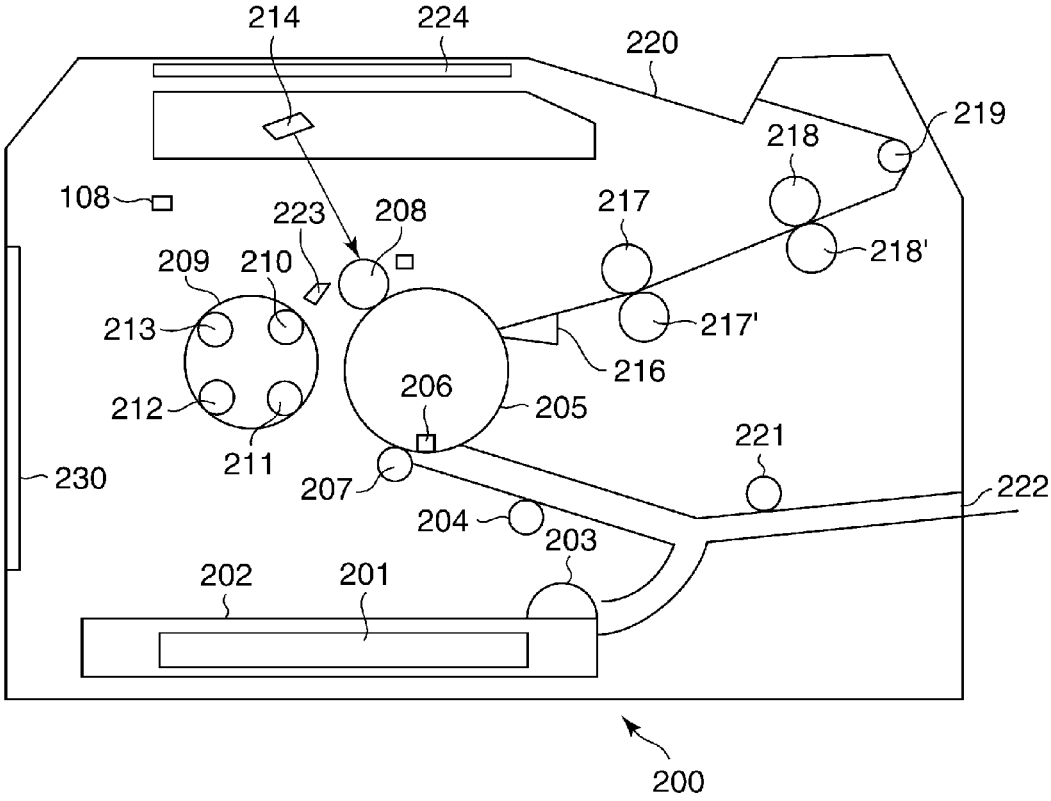
FIG. 2 is a schematic cross-sectional view of the image forming apparatus according to the embodiment.

FIG. 2 is a schematic cross-sectional view of an image forming apparatus according to the present embodiment. In FIG. 2, reference numeral 200 denotes a laser beam printer as the image forming apparatus. The printer 200 receives images, characters, and the like data from various kinds of external apparatuses including a host computer, and forms and outputs images, characters, etc. on recording media.

In FIG. 2, reference numeral 201 denotes sheets as recording media, and 202 denotes a sheet cassette holding the sheets 201.

In FIG. 2, reference numeral 203 denotes a cassette sheet-feeding clutch that separates only an uppermost one of the sheets 201 set in the sheet cassette 202. The cassette sheet-feeding clutch 203 has a portion thereof formed into a cam shape, and is rotated by a drive unit, not shown, for feeding the sheets 201 separately one by one. The cassette sheet-feeding clutch 203 conveys each separate sheet until the leading edge of the sheet reaches a sheet feed roller 204. Thus, the cassette sheet-feeding clutch 203 operates to feed one sheet 201 per single rotation thereof. The sheet feed roller 204 performs rotation while slightly pressing a sheet 201 conveyed by the cassette sheet-feeding clutch 203, to thereby further convey the sheet 201.

In FIG. 2, reference numeral 222 denotes a sheet tray, and 221 denotes a manual sheet feeding clutch. The sheet tray 222 and the manual sheet feeding clutch 221 make it possible to manually feed sheets one by one from the sheet tray 222.

Thus, sheet feeding is enabled not only from the sheet cassette 202, but also from the sheet tray 222.

In FIG. 2, reference numeral 205 denotes a transfer drum, reference numeral 206 denotes a gripper for nipping the leading end of a sheet, and reference numeral 207 denotes a conveying roller. During a printing operation, the transfer drum 205 rotates at a predetermined speed. When the transfer drum 205 rotates and brings the gripper 206 thereon to the leading end of the sheet, the gripper 206 nips the leading end of the sheet. Thereafter, the sheet 201 is wound around the transfer drum 205 in accordance with rotation of the conveying roller 207 and is conveyed.

In FIG. 2, reference numeral 208 denotes a photosensitive drum, reference numeral 209 denotes a developing device support, reference numeral 210 denotes a yellow (Y) toner developing device, reference numeral 211 denotes a magenta (M) toner developing device, reference numeral 212 denotes a cyan (C) toner developing device, and reference numeral 213 denotes a black (K) toner developing device.

The developing device support 209 is intermittently rotated through a predetermined angle to move one of the developing devices of a desired color toner to a development position on the photosensitive drum 208.

In FIG. 2, reference numeral 214 denotes a laser driver. The laser driver 214 turns on and off a semiconductor laser according to dot data delivered from a control unit 224 (see FIG. 1). As a consequence, the laser driver 214 scans the surface of the photosensitive drum 208 in the main scanning direction by a modulated laser beam to thereby form an electrostatic latent image along a main scan line. At this time, the rotation of the photosensitive drum 208 is controlled such that the location of the formed latent image is synchronized with the location of the sheet 201 on the transfer drum 205. Through this operation of the photosensitive drum 208, the surface of the photosensitive drum 208, which has been charged by an electrostatic charger, not shown, has the latent image for one page formed thereon by being exposed to the laser beam produced by the laser driver 214.

The latent image thus formed on the photosensitive drum 208 is developed as a toner image by a predetermined color toner from an associated one of the developing devices 210 to 213. The toner image formed on the photosensitive drum 208 is transferred onto the sheet 201 on the transfer drum 205.

By repeatedly carrying out the above-described operation, each latent image formed on the photosensitive drum 208 by the laser driver 214 in association with a desired color is developed by one of the developing devices containing the associated color toner. The toner images are superimposed one upon another on the sheet 201 on the transfer drum 205.

The sheet 201 having necessary toner images transferred thereon as described above is separated from the transfer drum 205 by a transfer separation claw 216, and the toner images are heated and fixed by a pair of fixing rollers 217 and 217'. Then, the sheet 201 having an image formed thereon is conveyed by conveying rollers 218, 218', and 219, followed by being discharged onto a discharge tray 220.

In FIG. 2, reference numeral 223 denotes a density sensor. The density sensor 223 is configured to detect the density of each of Y, M, C, and K patch toner images formed on the photosensitive drum 208. In the present image forming apparatus, the amount of toner adhering to the photosensitive drum for development changes due to replacement of a toner cartridge or the photosensitive drum or a change in ambient temperature, humidity, etc., similarly to a general printer or the like.

For this reason, in the present image forming apparatus, the density of a toner image is measured when a part is replaced or when an ambient condition, such as temperature or humidity, has changed, or in predetermined timing defined by a predetermined time interval. In measuring the density of a toner image, a patch toner image is formed according to predetermined density data on the photosensitive drum, and the density of the patch toner image is measured by the density sensor 223, whereby a density at the time is determined.

Figure 1:
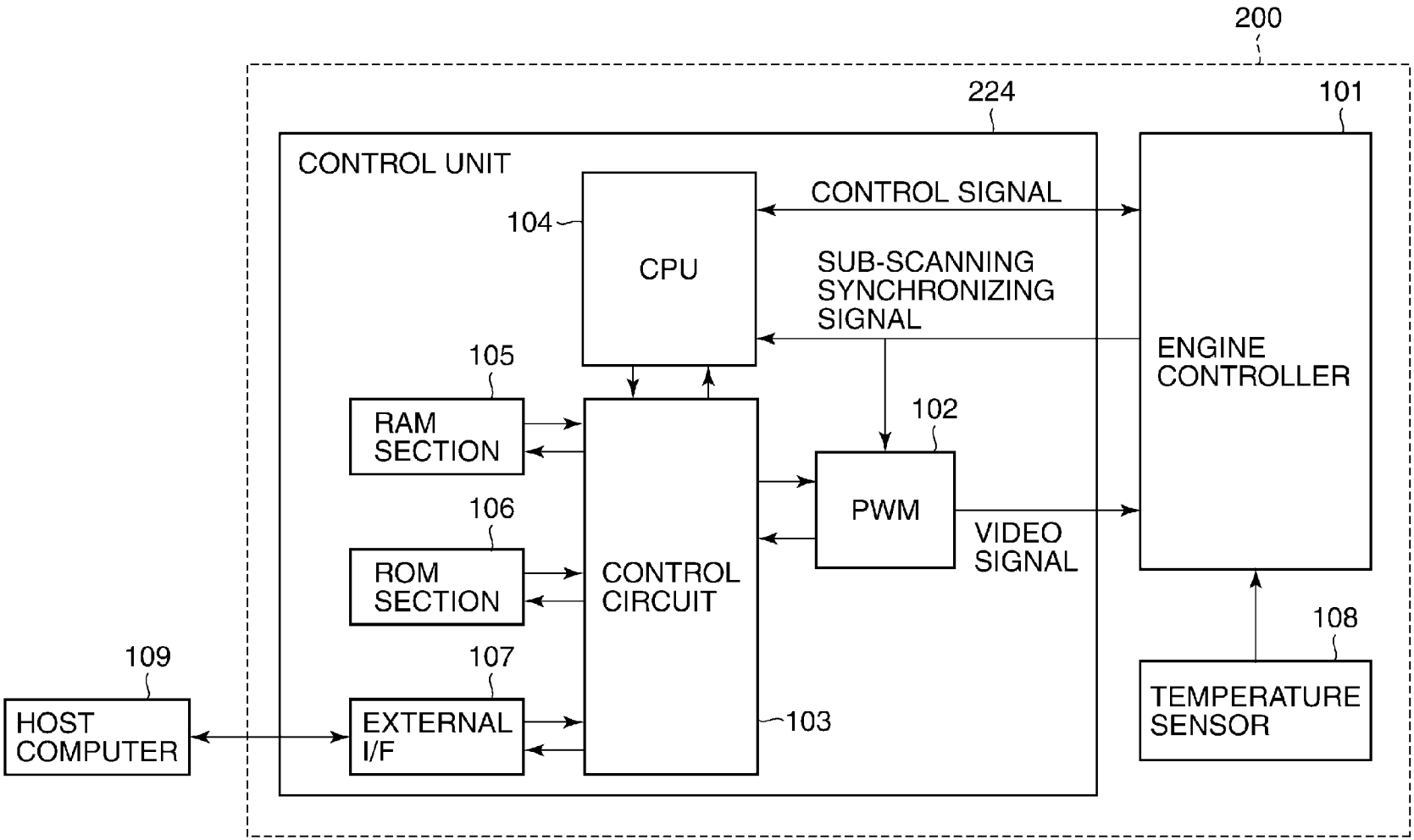
FIG. 1 is a schematic diagram of a printing system including an image forming apparatus according to an embodiment of the present invention.

Next, a description will be given of the arrangement of a printing system including the laser printer 200 and a host computer 109, with reference to FIG. 1.

The control unit 224 of the laser printer 200 has a CPU 104. The CPU 104 controls the laser printer 200 by executing a control program stored in a ROM section 106. A RAM section 105 provides an area for storing recorded data for printing, which was sent from the host computer 109, and serves as a work memory to provide a work area necessitated by the CPU 104 for execution of various control operations.

The control unit 224 includes a control circuit 103 connected to the CPU 104, the ROM section 106, and the RAM section 105. The control circuit 103 controls transfer of image data to an engine controller 101.

The control unit 224 is provided with an external interface section 107 for exchange of control signals with the host computer 109, reception of data therefrom, and so forth.

The control unit 224 is provided with a PWM (pulse width modulator) 102 that performs correction and like processing on various images and transfers corrected video data to the engine controller 101.

The engine controller 101 performs control e.g. for sheet conveyance. The engine controller 101 also monitors internal temperature rise within the main unit of the printer 200 based on temperature data detected by a temperature sensor 108.

The host computer 109 delivers data for various kinds of printing operations to the printer 200. The host computer 109 is capable of displaying the status of the printer on a monitor and providing information necessary for the user.

Figure 3:
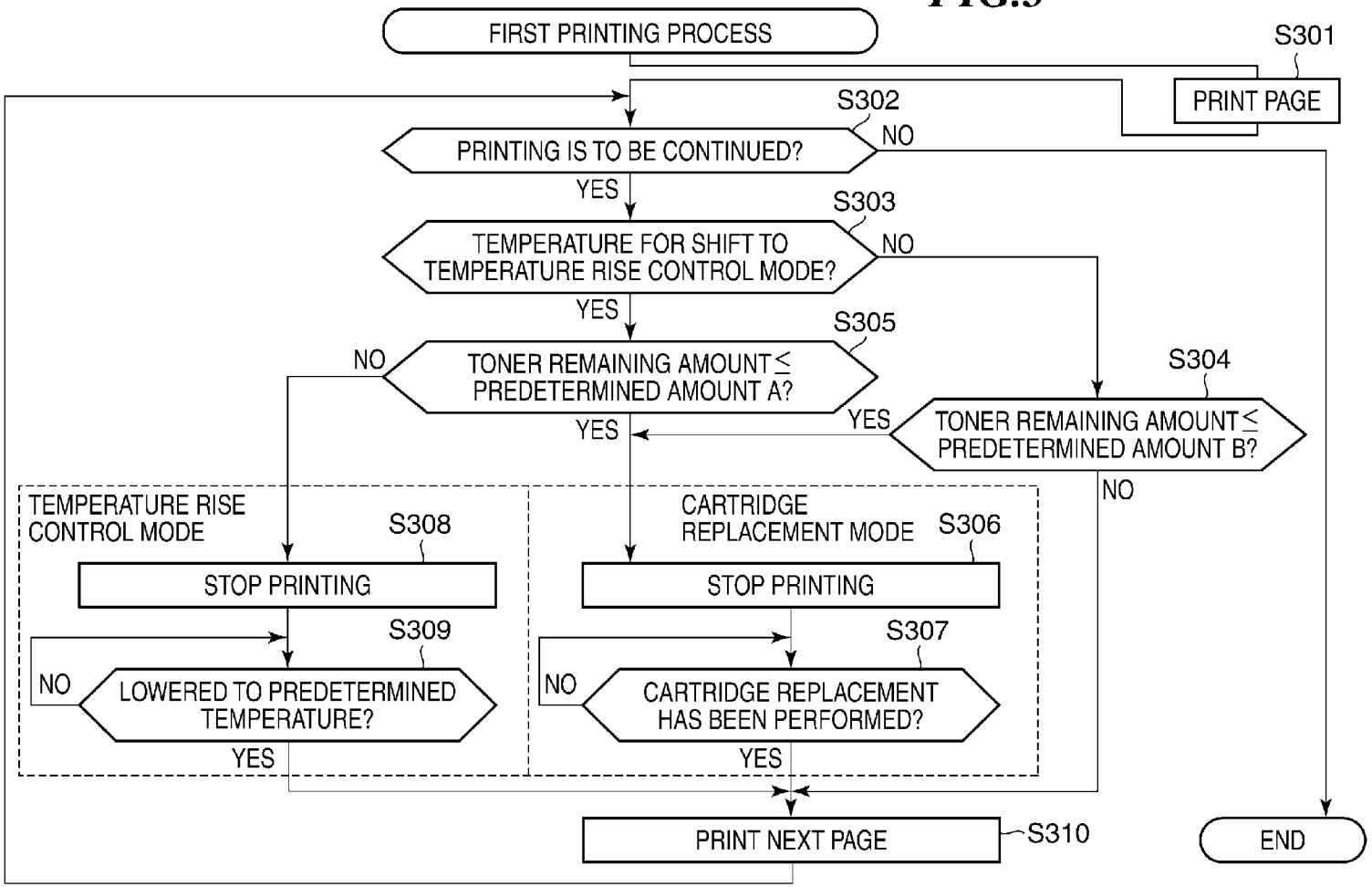
FIG. 3 is a flowchart of a first printing process executed by the image forming apparatus according to the embodiment.

Next, a description will be given of a first printing process executed by the printing system configured as above, with reference to FIG. 1 and FIG. 3. FIG. 3 is a flowchart of the first printing process.

In the printing system, when the printer 200 receives a print command e.g. from the host computer 109, the first printing process is started. When the first printing process is started, a printing start signal is delivered from the CPU 104 appearing in FIG. 1 to the engine controller 101 also appearing in FIG. 1. The engine controller 101 having received the printing start signal outputs a sub-scanning synchronizing signal, and the PWM 102 outputs an image signal according to the sub-scanning synchronizing signal. That is, in the first printing process shown in FIG. 3, the CPU 104 causes the printer 200 to execute printing of a first page in a step S301.

Next, the CPU 104 determines whether or not to continue printing, by determining based on the print command whether or not the page of which printing has just been completed is a final page (step S302). If the printed page is a final page and hence printing is not to be continued (NO to the step S302), the CPU 104 terminates the first printing process. On the other hand, if it is determined that printing is to be continued (YES to the step S302), the CPU 104 proceeds to a step S303.

In the printer 200, the temperature sensor 108 connected to the engine controller 101 constantly detects the internal temperature of the printer 200, so that the CPU 104 can obtain information on the internal temperature of the printer 200 via the engine controller 101.

In the step S303, the CPU 104 determines whether or not the temperature detected by the temperature sensor 108 has reached a predetermined temperature at which the printer 200 should shift to a temperature rise control mode. If the detected temperature has not reached the temperature for the printer 200 to shift to the temperature rise control mode (NO to the step S303), the CPU 104 sets a temperature rise control mode flag to OFF, and then proceeds to a step S304.

On the other hand, if it is determined in the step S303 that the temperature detected by the temperature sensor 108 has reached the temperature for the printer 200 to shift to the temperature rise control mode (YES to the step S303), the CPU 104 sets the temperature rise control mode flag to ON, and then proceeds to a step S305.

In the step S305, the CPU 104 determines whether or not a detected remaining amount of toner is equal to or smaller than a predetermined amount A indicative of a toner shortage state. If the detected remaining amount of toner is equal to or smaller than the predetermined amount A, the CPU 104 proceeds to a step S306, whereas if not, the CPU 104 proceeds to a step S308.

In the step S308, since the temperature rise control mode flag is ON, the CPU 104 causes the printer 200 to enter the temperature rise control mode, display an indication that the printer is being cooled, and stop the printing operation.

Then, the CPU 104 continues monitoring the temperature information from the temperature sensor 108, and when the internal temperature of the printer 200 becomes equal to or lower than a predetermined temperature (YES to a step S309), the CPU 104 sets the temperature rise control mode flag to OFF, and then proceeds to a step S310.

If the CPU 104 determines in the step S305 that the remaining amount of toner is equal to or smaller than the predetermined amount A, the CPU 104 proceeds to the step S306, wherein the CPU 104 causes the printer 200 to enter a cartridge replacement mode. In the step S306, the CPU 104 causes the host computer 109 to display an indication for prompting the user to perform cartridge replacement, and stop the printing operation, and then proceeds to a step S307.

In the step S307, the CPU 104 waits for the user to complete cartridge replacement (NO to the step S307), and if cartridge replacement is performed by the user (YES to the step S307), the CPU 104 sets the flag to OFF provided that the temperature rise control mode flag is ON, and proceeds to the step S310. If cartridge replacement is performed with the temperature rise control mode flag ON, continuous printing time is broken as shown in FIG. 7, and the continuous printing operation is interrupted.

Figure 6:
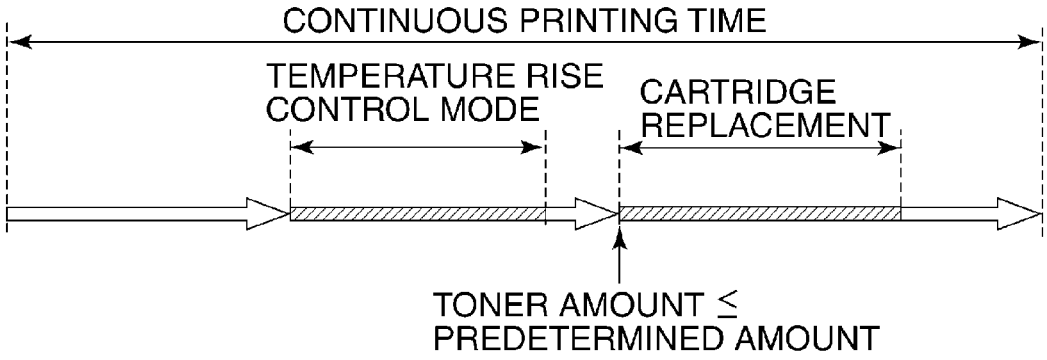
FIG. 6 is a diagram useful in explaining a continuous printing time required for a conventional printing process executed by a conventional image forming apparatus, for comparison with the present embodiment.
Figure 7:
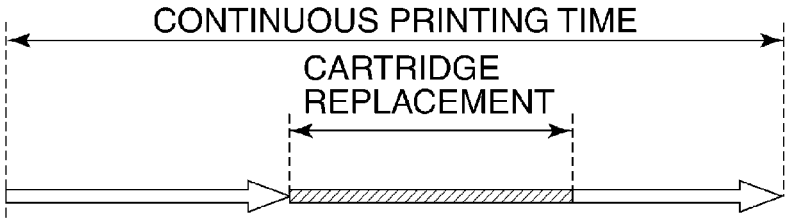
FIG. 7 is a diagram useful in explaining a continuous printing time realized by the first printing process executed by the image forming apparatus according to the present embodiment.

In a case where cartridge replacement is performed in timing shown in FIG. 7, the internal temperature of the printer 200 falls during the cartridge replacement, so that it is possible to obtain the same effect as provided by lowering the internal temperature of the printer 200 in the temperature rise control mode, in a pseudo manner. Therefore, when cartridge replacement is performed in timing shown in FIG. 7, it is possible to make time required for continuous printing shorter than in the FIG. 6 case.

If the CPU 104 determines that the detected internal temperature has not reached the temperature for the printer 200 to shift to the temperature rise control mode (NO to the step S303), the CPU 104 proceeds to the step S304, as mentioned hereinabove. In the step S304, the CPU 104 determines whether the remaining amount of toner is equal to or smaller than a predetermined amount B set as a level where printing is not allowable. If the remaining amount of toner is equal to or smaller than the predetermined amount B (YES to the step S304), the CPU 104 proceeds to the step S306 et seq. and executes the processing described hereinabove. On the other hand, if the CPU 104 determines that the remaining amount of toner is larger than the predetermined amount B (NO to the step S304), the CPU 104 directly proceeds to the step S310.

In the step S310, the CPU 104 causes the printer 200 to execute printing of the next page, and returns to the step S302. The present first printing process is terminated, as mentioned hereinbefore, when it is determined in the step S302 that the page having been just printed is a final page.

Figure 4:
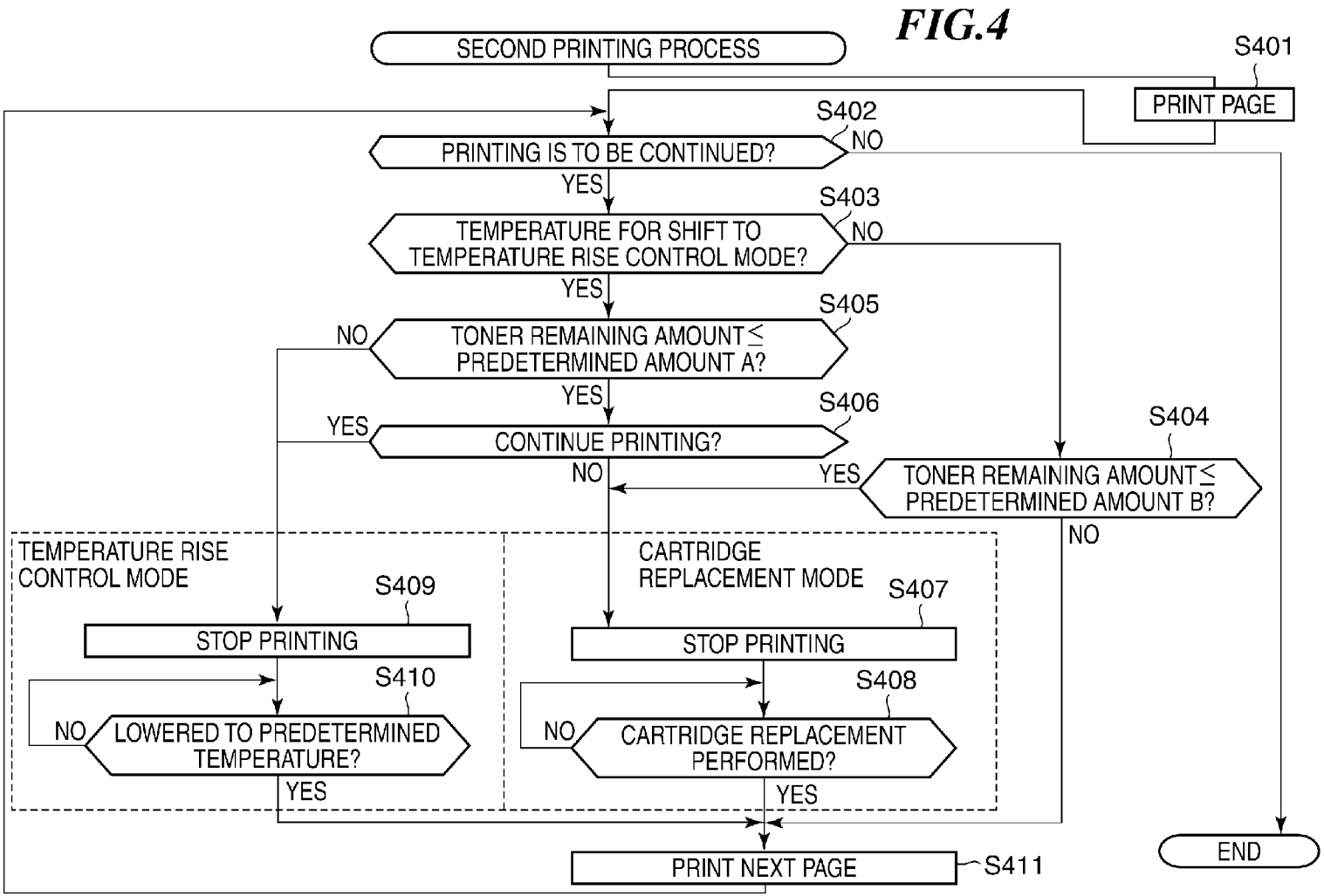
FIG. 4 is a flowchart of a second printing process executed by the image forming apparatus according to the embodiment.

Next, a description will be given of a second printing process executed by the present printing system, with reference to FIG. 4. FIG. 4 is a flowchart of the second printing process.

In the first printing process described above with reference to FIG. 3, control is performed such that when the internal temperature has reached the predetermined temperature for the printer 200 to shift to the temperature rise control mode, the printer 200 is switched to the cartridge replacement mode on condition that the remaining amount of toner is not larger than the predetermined toner amount.

The second printing process is distinguished from the first printing process in that when the remaining amount of toner is not larger than the predetermined toner amount, it is possible to select whether to shift to the cartridge replacement mode or to the temperature rise control mode.

In the present printing system, when the printer 200 receives a print command e.g. from the host computer, the printing process shown in FIG. 4 is started.

When the present printing process is started, the CPU 104 causes the printer to execute printing of a first page (S401). Next, the CPU 104 determines based on the print command whether or not to continue printing, by determining based on the print command whether or not the page of which printing has just been completed is a final page (step S402). If the printed page is a final page and hence printing is not to be continued (NO to the step S402), the CPU 104 terminates the second printing process. On the other hand, if it is determined that printing is to be continued (YES to the step S402), the CPU 104 proceeds to a step S403.

In the step S403, the CPU 104 determines whether or not a temperature detected by the temperature sensor 108 has reached a predetermined temperature for the printer 200 to shift to the temperature rise control mode. If the detected temperature has not reached the temperature for the printer 200 to shift to the temperature rise control mode (NO to the step S403), the CPU 104 sets the temperature rise control mode flag to OFF, and then proceeds to a step S404.

On the other hand, if it is determined in the step S403 that the temperature detected by the temperature sensor 108 has reached the temperature for the printer 200 to shift to the temperature rise control mode (YES to the step S403), the CPU 104 sets the temperature rise control mode flag to ON, and proceeds to a step S405.

In the step S405, the CPU 104 determines whether or not a detected remaining amount of toner is equal to or smaller than the predetermined amount A. If the detected remaining amount of toner is not larger than the predetermined amount A, the CPU 104 proceeds to a step S406, whereas if the detected remaining amount of toner is larger than the predetermined amount A, the CPU 104 proceeds to a step S409.

In the step S406, the CPU 104 causes the host computer 109 to display on the monitor a message for prompting the user to select whether to continue printing or to perform cartridge replacement. Thus, the user can select whether to cause the printer 200 to continue printing and enter the temperature rise control mode, or to perform cartridge replacement.

If the user selects causing the printer 200 to continue printing (YES to the step S406), the CPU 104 proceeds to the step S409, wherein the temperature rise control mode is set and printing is stopped, and then the CPU 104 proceeds to a step S410.

In the step S410, the CPU 104 monitors the temperature information from the temperature sensor 108 and waits for the internal temperature of the printer 200 to become equal to or lower than a predetermined temperature (NO to the step S410). Then, when it is determined that the temperature detected by the temperature sensor 108 has become equal to or lower than the predetermined temperature (YES to the step S410), the CPU 104 sets the temperature rise control mode flag to OFF, and then proceeds to a step S411.

On the other hand, if the user selects cartridge replacement (NO to the step S406), the CPU 104 proceeds to a step S407, wherein the CPU 104 causes the printer 200 to shift to the cartridge replacement mode and stop printing.

Then, the CPU 104 suspends the printing operation until completion of a cartridge replacement operation (NO to a step S408), and if the cartridge replacement operation has been completed, the CPU 104 sets the flag to OFF provided that the temperature rise control mode flag is ON, and then proceeds to the step S411.

On the other hand, if the CPU 104 determines that the temperature detected by the temperature sensor 108 has not reached the temperature for the printer 200 to shift to the temperature rise control mode (NO to the step S403), the CPU 104 proceeds to the step S404 as mentioned hereinbefore. In the step S404, the CPU 104 determines whether or not the remaining amount of toner is equal to or smaller than the predetermined amount B set as a level where printing is not allowable. If the remaining amount of toner is equal to or smaller than the predetermined amount B (YES to the step S404), the CPU 104 proceeds to the step S407 et seq. and executes the processing described hereinabove. On the other hand, if the CPU 104 determines that the remaining amount of toner is larger than the predetermined amount B (NO to the step S404), the CPU 104 proceeds to the step S411.

In the step S411, the CPU 104 causes the printer 200 to execute printing of the next page, and then returns to the step S402. The present second printing process is terminated, as mentioned hereinbefore, when it is determined in the step S402 that the page having been just printed is a final page.

Figure 5:
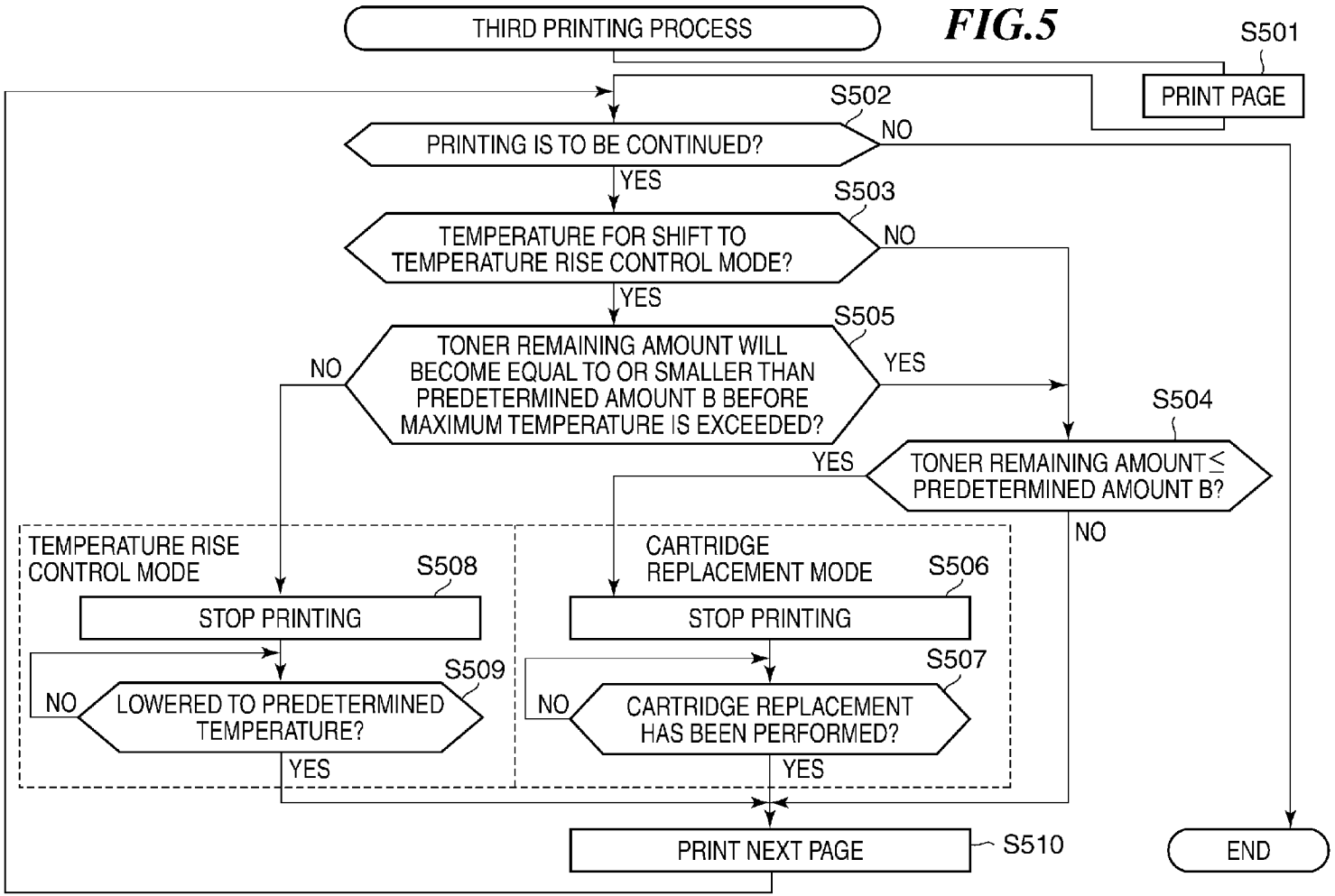
FIG. 5 is a flowchart of a third printing process executed by the image forming apparatus according to the embodiment.

Next, a description will be given of a third printing process executed by the present printing system, with reference to FIG. 5. FIG. 5 is a flowchart of the third printing process.

In the first printing process described hereinbefore with reference to FIG. 3, control is performed such that when the internal temperature has reached the temperature for the printer 200 to shift to the temperature rise control mode, the printer 200 is switched to the cartridge replacement mode on condition that the remaining amount of toner is not larger than the predetermined toner amount.

The third printing process is executed based on a distinction between a case where the internal temperature has reached the temperature for the printer 200 to shift to the normal temperature rise control mode and a case where the internal temperature has reached an absolute maximum temperature. The absolute maximum temperature is defined as a temperature which must not be exceeded from the viewpoint of apparatus performance.

The third printing process is started when the printer 200 of the printing system receives a print command e.g. from the host computer. When the third printing process is started, the printing start signal is delivered from the CPU 104 appearing in FIG. 1 to the engine controller 101 also appearing in FIG. 1. The engine controller 101 having received the printing start signal outputs a sub-scanning synchronizing signal, and the PWM 102 outputs an image signal according to the sub-scanning synchronizing signal. That is, in the third printing process shown in FIG. 5, the CPU 104 causes the printer 200 to execute printing of a first page in a step S501.

Next, the CPU 104 determines whether or not to continue printing, by determining based on the print command whether or not the page of which printing has just been completed is a final page (step S502). If the printed page is a final page and hence printing is not to be continued (NO to the step S502), the CPU 104 terminates the third printing process. On the other hand, if it is determined that printing is to be continued (YES to the step S502), the CPU 104 proceeds to a step S503.

In the printer 200, the temperature sensor 108 connected to the engine controller 101 constantly detects the internal temperature of the printer 200, so that the CPU 104 can obtain temperature information via the engine controller 101.

In the step S503, the CPU 104 determines whether or not the temperature detected by the temperature sensor 108 has reached a predetermined temperature for the printer 200 to shift to the temperature rise control mode. If the detected temperature has not reached the temperature for the printer 200 to shift to the temperature rise control mode (NO to the step S503), the CPU 104 sets the temperature rise control mode flag to OFF, and then proceeds to a step S504.

On the other hand, if it is determined in the step S503 that the temperature detected by the temperature sensor 108 has reached the temperature for the printer 200 to shift to the temperature rise control mode (YES to the step S503), the CPU 104 sets the temperature rise control mode flag to ON, and then proceeds to a step S505.

In the step S505, the CPU 104 determines whether or not the remaining amount of toner will become equal to or smaller than the predetermined amount B before the absolute maximum temperature is exceeded. If the CPU 104 determines that the remaining amount of toner will not become equal to or smaller than the predetermined amount B before the absolute maximum temperature is exceeded (NO to the step S505), the CPU 104 proceeds to a step S508. In the step S508, since the temperature rise control mode flag is ON, the CPU 104 causes the printer 200 to enter the temperature rise control mode, display an indication that the printer is being cooled, and stop the printing operation.

Then, in a step S509, the CPU 104 monitors the temperature information from the temperature sensor 108 and waits for the internal temperature detected by the temperature sensor 108 to become equal to or lower than a predetermined temperature (NO to the step S509). When it is determined that the temperature detected by the temperature sensor 108 has become equal to or lower than the predetermined temperature (YES to the step S509), the CPU 104 sets the temperature rise control mode flag to OFF, and then proceeds to a step S510.

On the other hand, if it is determined in the step S505 that the remaining amount of toner will become equal to or smaller than the predetermined amount B before the absolute maximum temperature is exceeded (YES to the step S505), the CPU 104 sets the temperature rise control mode flag to OFF, and then proceeds to a step S504.

In the step S504, the CPU 104 determines whether or not the remaining amount of toner is equal to or smaller than the predetermined amount B. If the CPU 104 determines that the remaining amount of toner is larger than the predetermined amount B (NO to the step S504), the CPU 104 directly proceeds to the step S510. On the other hand, if it is determined that the remaining amount of toner is equal to or smaller than the predetermined amount B (YES to the step S504), the CPU 104 causes the printer 200 to enter the cartridge replacement mode and stop printing in a step S506.

Then, the CPU 104 suspends the printing operation until completion of a cartridge replacement operation (NO to a step S507). If it is determined that the cartridge replacement operation has been completed (YES to the step S507), the CPU 104 sets the flag to OFF provided that the temperature rise control mode flag is ON, and then proceeds to the step S510.

In the step S510, the CPU 104 causes the printer 200 to execute printing of the next page, and then returns to the step S502. The present second printing process is terminated, as mentioned hereinbefore, when it is determined in the step S502 that the page having been just printed is a final page.

Figure 8:
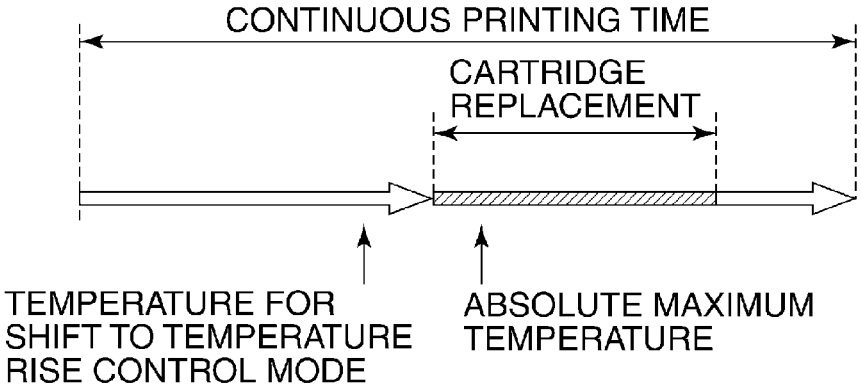
FIG. 8 is a diagram useful in explaining a continuous printing time realized by the third printing process executed by the image forming apparatus according to the present embodiment.

In the above-described third printing process, the CPU 104 performs control such that printing is continued even after the detected internal temperature has reached the temperature for the printer 200 to shift to the temperature rise control mode. Therefore, a continuous printing time in this case becomes as shown in FIG. 8.

More specifically, in the third printing process, even after the detected internal temperature has reached the temperature for the printer 200 to shift to the temperature rise control mode, the CPU 104 performs control such that the printer 200 enters the cartridge replacement mode before the internal temperature exceeds the absolute maximum temperature. As a consequence, in the third printing process, it is possible to lower the internal temperature during cartridge replacement, so that reduction of the continuous printing time can be achieved without degradation of printing performance.

In the above-described third printing process, predictive determination is performed when the internal temperature of the apparatus main unit detected by the temperature detection unit exceeds the upper limit threshold value during continuous printing performed using a continuous printing function. In the predictive determination, it is predicted whether or not, during a continuous printing operation, the remaining amount of toner will become equal to or smaller than the predetermined amount set as a level where printing is not allowable before the internal temperature of the apparatus main unit exceeds the absolute maximum temperature that must not be exceeded from the viewpoint of apparatus performance. Then, when it is predicted in the predictive determination that the remaining amount of toner will become equal to or smaller than the level where printing is not allowable, before the absolute maximum temperature is exceeded, a function of controlling toner consumption is operated. The function of controlling toner consumption is operated to perform control such that an operation for continuous printing is continued until the remaining amount of toner becomes equal to or smaller than the level where printing is not allowable, and then a standby function for cartridge replacement is executed.

In short, the image forming apparatus of the present embodiment is configured to be capable of executing a job for continuous printing according to a print command received e.g. from the host computer 109 constituting the printing system together with the image forming apparatus. Further, the CPU 104 as a controller of the present image forming apparatus is configured to be capable of acquiring a continuous printing time required for a continuous printing operation from information contained in the received print command.

The control unit 224 of the present image forming apparatus is connected to the engine controller 101 that constantly monitors temperature rise within the printer 200 based on temperature information from the temperature sensor 108 disposed within the apparatus main unit. In the printer 200 as the image forming apparatus, the CPU 104 as a controller is configured to be capable of detecting the temperature information via the engine controller 101.

Figure 9:
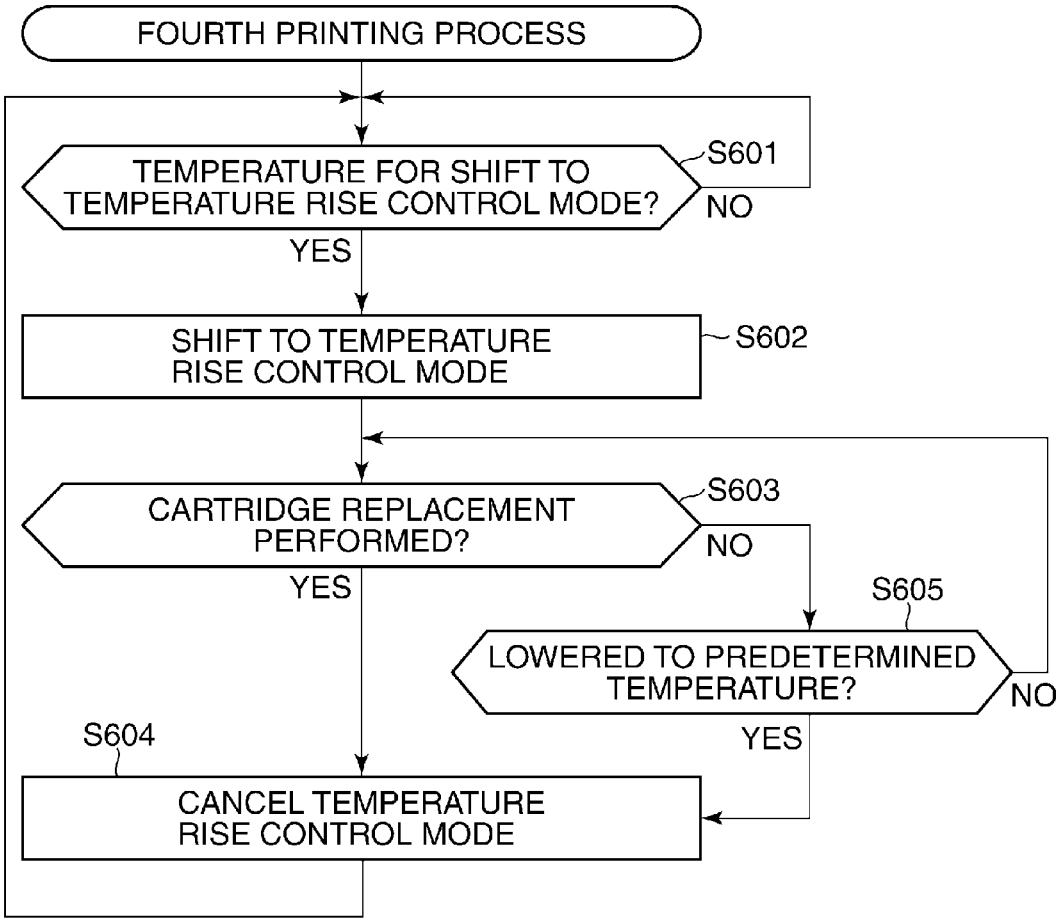
FIG. 9 is a flowchart of a fourth printing process executed by the image forming apparatus according to the present embodiment.

Next, a description will be given of a fourth printing process executed by the present printing system, with reference to FIG. 9. FIG. 9 is a flowchart of the fourth printing process. Note that in this flowchart, there is described processing concerning execution of the temperature rise control mode, which corresponds to a range of the steps S303 to S309 of the first printing process in FIG. 3, in an extracted manner, and hence it is to be understood that printing of pages per se is executed in the same manner as in the first printing process.

In the fourth printing process, when cartridge replacement is performed after shift to the temperature rise control mode, the temperature rise control mode is canceled. In the following, the fourth printing process will be described in detail.

During execution of printing, the CPU 104 determines whether or not the temperature detected by the temperature sensor 108 has reached the temperature for the printer 200 to shift to the temperature rise control mode (step S601). If it is determined in the step S601 that the temperature detected by the temperature sensor 108 has reached the temperature for the printer 200 to shift to the temperature rise control mode (YES to the step S601), the CPU 104 causes the printer 200 to shift to the temperature rise control mode. As a consequence, execution of printing by the printer 200 is stopped. At this time, the CPU 104 holds the temperature rise control mode flag ON.

Thereafter, the CPU 104 determines whether or not toner cartridge replacement has been performed (step S603). If the CPU 104 determines that toner cartridge replacement has been performed (YES to the step S603), the temperature rise control mode of the printer 200 is cancelled (step S604). As a consequence, execution of printing by the printer 200 is resumed. At this time, the CPU 104 sets the temperature rise control mode flag to OFF.

On the other hand, if it is determined in the step S603 that toner cartridge replacement has not been performed (NO to the step S603), the CPU 104 determines whether or not the temperature detected by the temperature sensor 108 has become equal to or lower than a predetermined temperature for canceling the temperature rise control mode (step S605). If it is determined in the step S605 that the temperature detected by the temperature sensor 108 has become equal to or lower than the predetermined temperature for canceling the temperature rise control mode (YES to the step S605), the CPU 104 cancels the temperature rise control mode of the printer 200 (step S604). As a consequence, execution of printing by the printer 200 is resumed. At this time, the CPU 104 sets the temperature rise control mode flag to OFF.

The timing for the CPU 104 to perform the determination as to whether or not to shift to the temperature rise control mode may be whenever a single page is printed or whenever a plurality of pages are printed.

In the fourth printing process, in a case where the printer 200 has shifted to the temperature rise control mode, if toner cartridge replacement is performed, the temperature rise control mode is canceled. When toner cartridge replacement is performed, the internal temperature of the printer 200 necessarily falls during the toner cartridge replacement. This means that toner cartridge replacement and stoppage of printing after shift to the temperature rise control mode provide the same effect in respect of lowering the temperature of the printer 200.

Although in the above-described embodiments, toner cartridge replacement is detected, this is not limitative, but removal and mounting of cartridges may be detected. Further, although the internal temperature of the printer 200 is detected by the temperature sensor 108, this is not limitative either, but it is only required that the internal temperature of the printer 200 can be detected or estimated.

Figure 10:
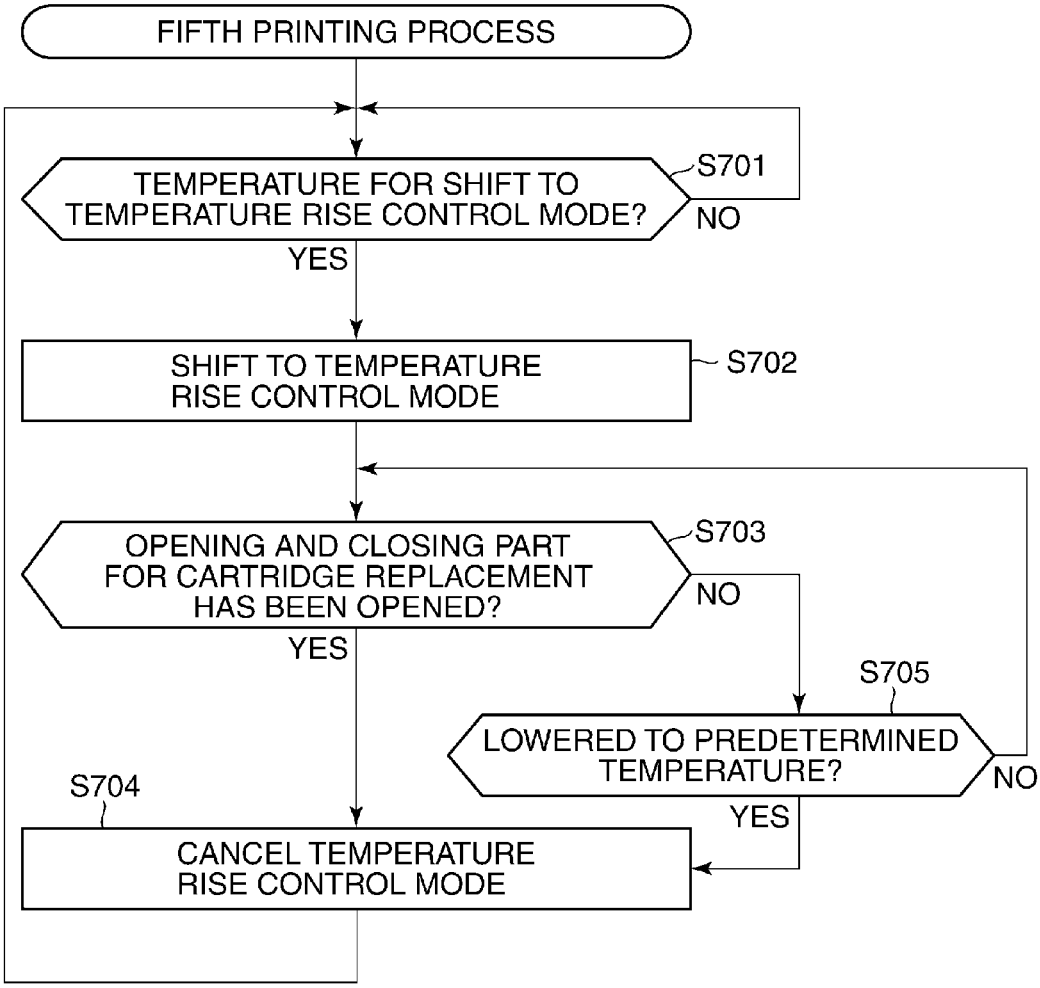
FIG. 10 is a flowchart of a fifth printing process executed by the image forming apparatus according to the present embodiment.

Next, a description will be given of a fifth printing process executed by the present printing system, with reference to FIG. 10. FIG. 10 is a flowchart of the fifth printing process. Note that in this flowchart, there is described processing concerning execution of the temperature rise control mode, which corresponds to a range of the steps S303 to S309 of the first printing process in FIG. 3, in an extracted manner, and hence it is to be understood that printing of pages per se is executed in the same manner as in the first printing process.

In the fifth printing process, when an opening/closing part 230 for cartridge replacement is opened after shift to the temperature rise control mode, the temperature rise control mode is canceled. In the following, the fifth printing process will be described in detail.

During execution of printing, the CPU 104 determines whether or not the temperature detected by the temperature sensor 108 has reached the temperature for the printer 200 to shift to the temperature rise control mode (step S701). If it is determined in the step S701 that the temperature detected by the temperature sensor 108 has reached the temperature for the printer 200 to shift to the temperature rise control mode (YES to the step S701), the CPU 104 causes the printer 200 to shift to the temperature rise control mode. As a consequence, execution of printing by the printer 200 is stopped. At this time, the CPU 104 holds the temperature rise control mode flag ON.

Thereafter, the CPU 104 determines whether or not the opening/closing part 230 for toner cartridge replacement has been opened (step S703). In the step S703, the CPU 104 performs the determination as to whether or not the opening/closing part 230 has been opened, after the printer 200 shifting to the temperature rise control mode. If the CPU 104 determines that the opening/closing part 230 has been opened (YES to the step S703), the temperature rise control mode of the printer 200 is cancelled (step S704). As a consequence, execution of printing by the printer 200 is resumed. At this time, the CPU 104 sets the temperature rise control mode flag to OFF.

On the other hand, if it is determined in the step S703 that the opening/closing part 230 has not been opened (NO to the step S703), the CPU 104 determines whether or not the temperature detected by the temperature sensor 108 has become equal to or lower than a predetermined temperature for canceling the temperature rise control mode (step S705). If it is determined in the step S705 that the temperature detected by the temperature sensor 108 has become equal to or lower than the predetermined temperature for canceling the temperature rise control mode (YES to the step S705), the CPU 104 cancels the temperature rise control mode of the printer 200 (step S704). As a consequence, execution of printing by the printer 200 is resumed. At this time, the CPU 104 sets the temperature rise control mode flag to OFF.

The timing for the CPU 104 to perform the determination as to whether or not to shift to the temperature rise control mode may be whenever a single page is printed or whenever a plurality of pages are printed.

In the fifth printing process, in a case where the printer 200 has shifted to the temperature rise control mode, when the opening/closing part 230 for toner cartridge replacement is opened, the temperature rise control mode is canceled. When the opening/closing part 230 is opened, high-temperature air within the printer 200 is released, so that the internal temperature of the printer 200 falls. This means that opening of the opening/closing part 230 and stoppage of printing after shift to the temperature rise control mode provide the same effect in reducing the temperature of the printer 200.

Although in the above-described embodiment, the CPU 104 detects opening of the opening/closing part 230, this is not limitative, but the CPU 104 is only required to detect closing of the opening/closing part 230.

In the present image forming apparatus, the developing device support 209 has the yellow (Y) toner developing device 210, the magenta (M) toner developing device 211, the cyan (C) toner developing device 212, and the black (K) toner developing device 213 mounted therein. Each of the developing devices attaches a toner to an electrostatic latent image formed on the transfer drum 205 to thereby generate a toner image of the associated color component. Although not shown, toner cartridges mounted in the respective developing devices mounted in the developing device support 209 are filled with C, M, Y, and K toners, respectively. Further, the toner cartridges are removably mounted in the respective developing devices. The present image forming apparatus is provided with a detection unit for detecting removal and mounting of toner cartridges. Although not shown, the detection unit detects a state where each toner cartridge has been mounted and a state where each toner cartridge has been removed, for example.

The present image forming apparatus is provided with a toner remaining amount detection unit for detecting the amount of toner remaining in each toner cartridge. Although not shown, for this toner remaining amount detection unit, it is possible to employ a general configuration in which the cumulative amount of toner consumption is recorded and the controller calculates the amount of toner remaining in a toner cartridge, for example. In the present case, whenever image data is supplied to the image forming apparatus, the amounts of the four color toners required for printing of an image of the image data are mathematically calculated based on the image data on a color component-by-color component basis. The calculated toner amounts are added to the respective cumulative amounts of toner consumption associated with the respective color components and stored.

Note that the toner remaining amount detection unit may be constructed by providing a sensor in each toner cartridge for detecting the amount of toner remaining in the associated toner cartridge.

The image forming apparatus is configured to execute a selected one of the first to fifth printing processes described hereinbefore. This makes it possible to prevent interruption of printing caused by shift to the temperature rise control mode and interruption of printing caused by a cartridge replacement operation due to running-out of toner from occurring separately in succession during execution of continuous printing, whereby an increase in printing operation suspension time can be avoided to thereby improve user friendliness of the image forming apparatus.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-264961, filed Nov. 29, 1010 which is hereby incorporated by reference herein in its entirety.

What is claimed is:

1. An image forming apparatus including a printing unit configured to print an image on a sheet, comprising:

a first detection unit configured to detect that an internal temperature of the image forming apparatus has become equal to or higher than a first temperature;

a second detection unit configured to detect replacement of a toner cartridge disposed in the image forming apparatus;

a control unit configured to control in a case where said first detection unit detects, during execution of printing by the printing unit, that the internal temperature of the image forming apparatus has become equal to or higher than the first temperature, the printing unit to stop the printing being executed; and a first execution resuming unit configured to control in a case where said second detection unit detects replacement of the toner cartridge during suspension of the printing stopped by said control unit, the printing unit to resume the printing being suspended.

2. The image forming apparatus according to claim 1, wherein said first detection unit further detects that the internal temperature of the image forming apparatus has become equal to or lower than a second temperature which is lower than the first temperature, the image forming apparatus further comprising a second execution resuming unit configured to be operable in a case where said first detection unit detects, during suspension of the printing stopped by said control unit, that the internal temperature of the image forming apparatus has become equal to or lower than the second temperature, to control the printing unit to resume the printing being suspended.

3. An image forming apparatus including a printing unit configured to perform printing based on input image data, comprising:

a first detection unit configured to detect that an internal temperature of the image forming apparatus has become equal to or higher than a first temperature;

a second detection unit configured to detect that an opening and closing part for replacement of a toner cartridge disposed in the image forming apparatus has been closed;

a control unit configured to control in a case where said first detection unit detects, during execution of printing by the printing unit, that the internal temperature of the image forming apparatus has become equal to or higher than the first temperature, the printing unit to stop the printing being executed; and a first execution resuming unit configured to control in a case where said second detection unit detects, during suspension of the printing stopped by said control unit, that the opening and closing part has been closed, the printing unit to resume the printing being suspended.

4. The image forming apparatus according to claim 3, wherein said first detection unit further detects that the internal temperature of the image forming apparatus has become equal to or lower than a second temperature which is lower than the first temperature, the image forming apparatus further comprising a second execution resuming unit configured to be operable in a case where said first detection unit detects, during suspension of the printing stopped by said control unit, that the internal temperature of the image forming apparatus has become equal to or lower than the second temperature, to control the printing unit to resume the printing being suspended.

5. An image forming apparatus including a printing unit configured to perform printing based on input image data, comprising:

a first detection unit configured to detect an internal temperature of the image forming apparatus;

a second detection unit configured to detect an amount of toner remaining in a toner cartridge; and a control unit configured to be operable during execution of printing by the printing unit, (1) in a case where the amount of toner remaining in the toner cartridge, which is detected by said second detection unit, is not larger than a first remaining amount, to suspend the printing being executed until replacement of the toner cartridge is performed, (2) in a case where the temperature detected by said first detection unit has become equal to or higher than a first temperature and where the amount of toner remaining in the toner cartridge, which is detected by said second detection unit, is not larger than a second remaining amount larger than the first remaining amount, to suspend the printing being executed until the replacement of the toner cartridge is performed, and (3) in a case where the temperature detected by said first detection unit has become equal to or higher than the first temperature and where the amount of toner remaining in the toner cartridge, which is detected by said second detection unit, is larger than the second remaining amount, to suspend the printing being executed until the temperature detected by said first detection unit becomes equal to or lower than a second temperature lower than the first temperature.

6. A method of controlling an image forming apparatus that performs printing based on input image data, comprising:

stopping printing being executed, in a case where an internal temperature of the image forming apparatus has become equal to or higher than a first temperature during execution of the printing; and resuming the printing being suspended, in a case where replacement of a toner cartridge is detected during suspension of the printing by said stopping.

7. A method of controlling an image forming apparatus that performs printing based on input image data, comprising:

stopping printing being executed, in a case where an internal temperature of the image forming apparatus has become equal to or higher than a first temperature during execution of the printing; and resuming the printing being suspended, in a case where an opening and closing part for replacement of a toner cartridge is closed during suspension of the printing by said stopping.

8. A non-transitory computer-readable storage medium storing a computer-executable program for causing a computer to execute a method of controlling an image forming apparatus that performs printing based on input image data, wherein the method comprises:

stopping printing being executed, in a case where an internal temperature of the image forming apparatus has become equal to or higher than a first temperature during execution of the printing; and resuming the printing being suspended, in a case where replacement of a toner cartridge is detected during suspension of the printing by said stopping.

9. A non-transitory computer-readable storage medium storing a computer-executable program for causing a computer to execute a method of controlling an image forming apparatus that performs printing based on input image data, wherein the method comprises:

stopping printing being executed, in a case where an internal temperature of the image forming apparatus has become equal to or higher than a first temperature during execution of the printing; and resuming the printing being suspended, in a case where replacement of a toner cartridge is detected during suspension of the printing by said stopping.

* * * * *